US011140963B2

(12) United States Patent
Jeon

(10) Patent No.: US 11,140,963 B2
(45) Date of Patent: Oct. 12, 2021

(54) CAP FOR SCALP CARE CONTAINER CAPABLE OF APPLYING LIQUID

(71) Applicant: Jeong Ho Jeon, Incheon (KR)

(72) Inventor: Jeong Ho Jeon, Incheon (KR)

( * ) Notice: Subject to any disclaimer, the term of this patent is extended or adjusted under 35 U.S.C. 154(b) by 0 days.

(21) Appl. No.: 15/557,357

(22) PCT Filed: Mar. 22, 2016

(86) PCT No.: PCT/KR2016/002844
§ 371 (c)(1),
(2) Date: Sep. 11, 2017

(87) PCT Pub. No.: WO2016/153248
PCT Pub. Date: Sep. 29, 2016

(65) Prior Publication Data

US 2018/0027942 A1 Feb. 1, 2018

(30) Foreign Application Priority Data

Mar. 24, 2015 (KR) ..... 10-2015-0040505

(51) Int. Cl.

| | |
|---|---|
| ***A45D 34/04*** | (2006.01) |
| ***A61H 23/06*** | (2006.01) |
| ***A61H 23/00*** | (2006.01) |
| ***A45D 24/22*** | (2006.01) |
| ***A46B 9/00*** | (2006.01) |
| ***A46B 11/00*** | (2006.01) |

(52) U.S. Cl.
CPC ..... *A45D 34/045* (2013.01); *A45D 24/22* (2013.01); *A46B 9/005* (2013.01); *A46B 11/0006* (2013.01); *A46B 11/0082* (2013.01); *A46B 11/0089* (2013.01); *A61H 23/00* (2013.01); *A61H 23/06* (2013.01); *A45D 2200/1036* (2013.01); *A46B 2200/102* (2013.01)

(58) Field of Classification Search
CPC ..... A45D 24/22; A45D 24/24; A45D 24/26; A45D 24/28; A45D 34/045; A45D 34/043; A45D 34/042; A45D 34/041; A45D 2200/1036; A45B 11/0001; A45B 11/002; A45B 11/0055; A45B 11/0082; A61M 35/003; A61M 35/006; A46B 11/0001; A46B 11/002; A46B 11/0055; A46B 11/0082; A46B 2200/102
USPC ..... 132/112–116; 401/290, 272, 270
See application file for complete search history.

(56) References Cited

U.S. PATENT DOCUMENTS 2,162,907 A * 6/1939 Bambach ..... A46B 11/0027 15/188
2,624,902 A * 1/1953 Soldner ..... B43K 5/1845 222/501

(Continued)

FOREIGN PATENT DOCUMENTS

JP 2009-240591 A 10/2009
KR 10-2001-0012660 A 2/2001

(Continued)

*Primary Examiner* — Heidi M Eide
(74) *Attorney, Agent, or Firm* — Rabin & Berdo, P.C.

(57) ABSTRACT

A cap for a scalp care container is capable of applying a liquid which is coupled to the scalp care container. The cap includes an upper cap provided with a plurality of bristles, and a lower cap coupled to the upper cap and fastened to the scalp care container.

1 Claim, 12 Drawing Sheets

(56) References Cited

U.S. PATENT DOCUMENTS

| | | | | |
|---|---|---|---|---|
| 4,310,009 | A * | 1/1982 | Shipp | A45D 24/22 132/114 |
| 4,966,484 | A * | 10/1990 | Kimura | A45D 34/042 401/148 |
| 5,902,060 | A * | 5/1999 | Rodriguez | A45D 26/0014 220/784 |
| 6,513,534 | B1 | 2/2003 | Sofer et al. | |
| 7,694,687 | B2 * | 4/2010 | Hurwitz | A01K 13/003 132/108 |
| 2005/0257800 | A1 * | 11/2005 | Inoue | A45D 24/26 132/114 |
| 2008/0060665 | A1 | 3/2008 | Umeno et al. | |
| 2010/0006590 | A1 * | 1/2010 | Withoos | A61M 35/006 222/1 |
| 2014/0286690 | A1 * | 9/2014 | Albisetti | B65D 35/36 401/261 |

FOREIGN PATENT DOCUMENTS

| | | | |
|---|---|---|---|
| KR | 20-0253682 | Y1 | 11/2001 |
| KR | 20-0353679 | Y1 | 6/2004 |
| KR | 10-2006-0047940 | A | 5/2006 |
| KR | 10-2007-0025429 | A | 3/2007 |
| KR | 10-1171130 | B1 | 8/2012 |
| KR | 10-2015-0016051 | A | 2/2015 |

* cited by examiner

[FIG. 1]
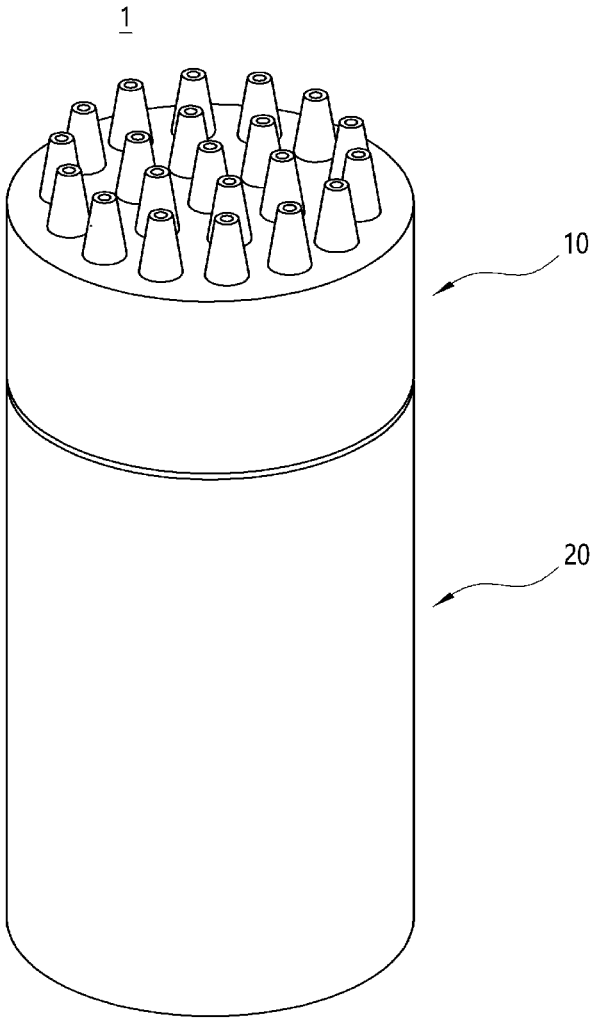

[FIG. 2]
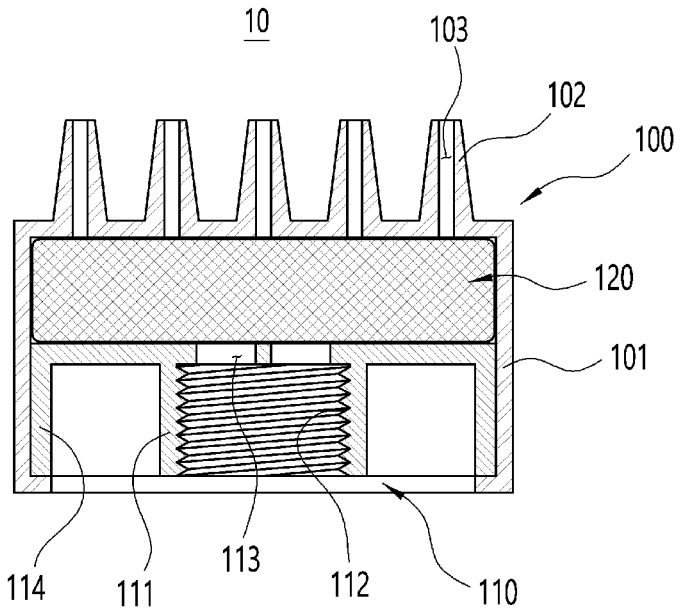
[FIG. 3]
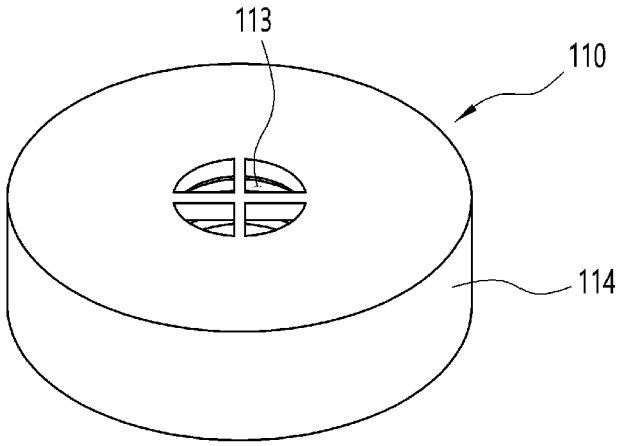

[FIG. 4]
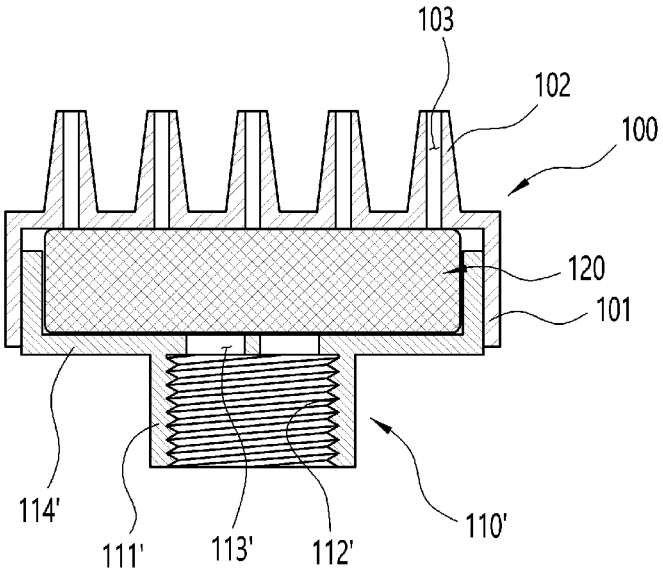
[FIG. 5]
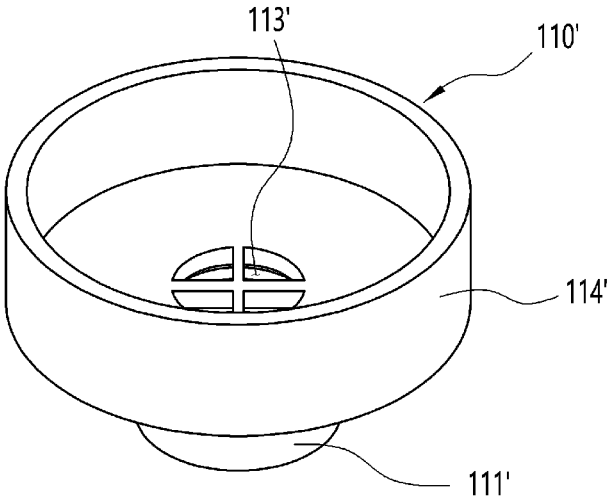

[FIG. 6]
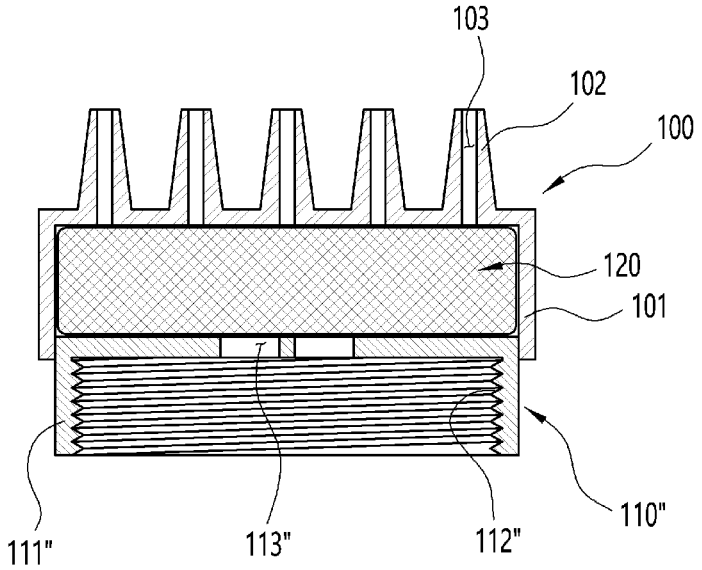
[FIG. 7]
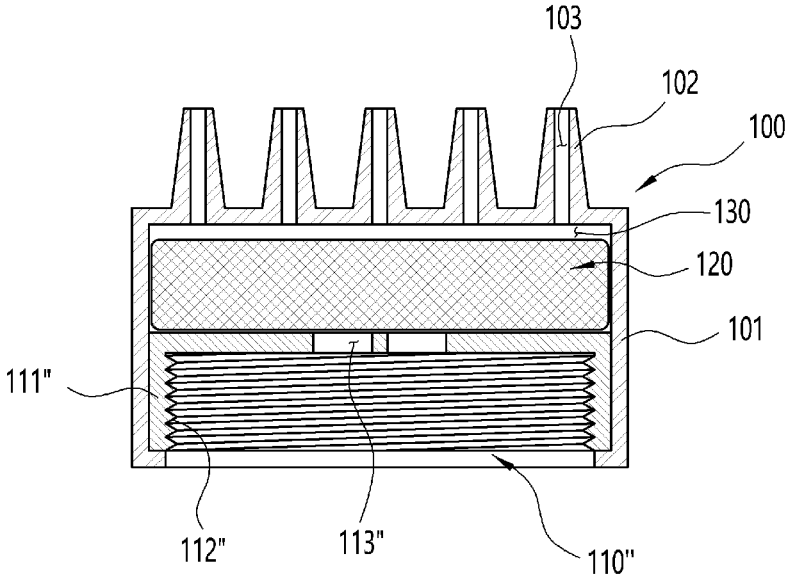

[FIG. 8]
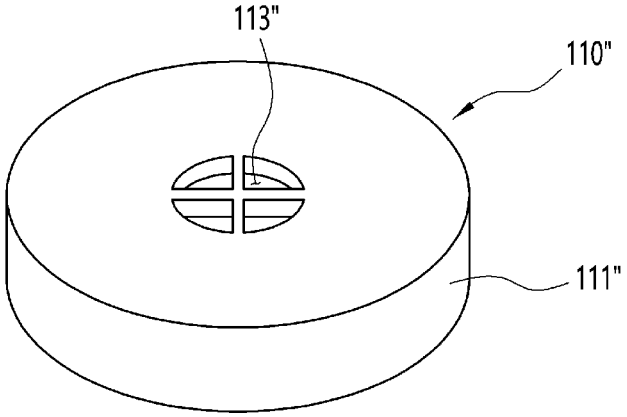
[FIG. 9]
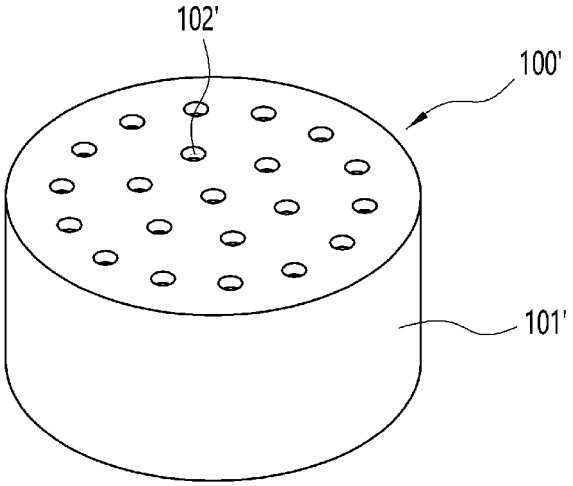

[FIG. 10]
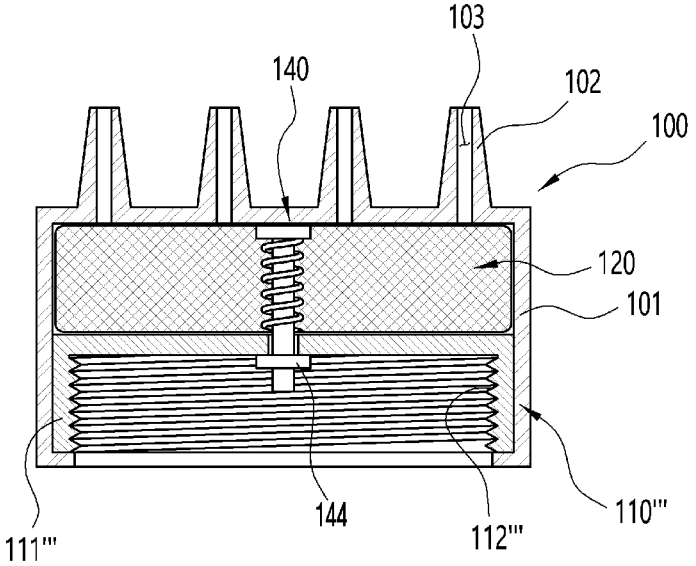
[FIG. 11]
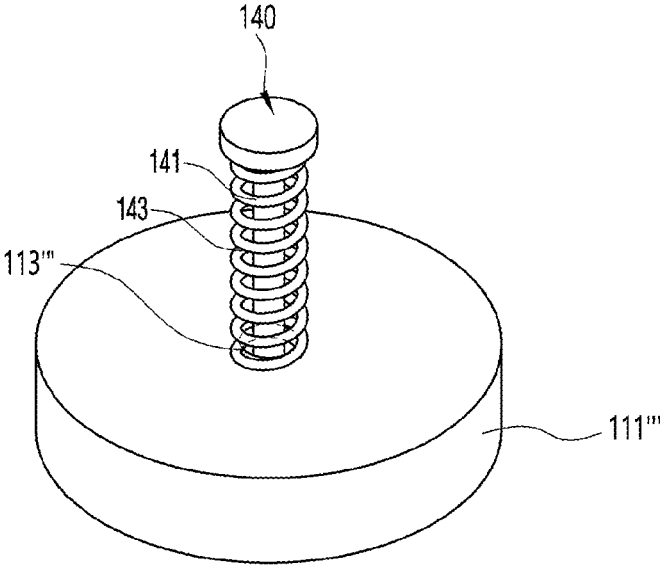

[FIG. 12]
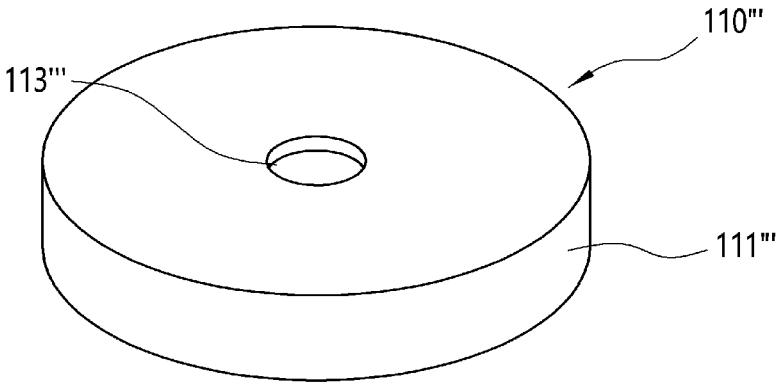

[FIG. 13]
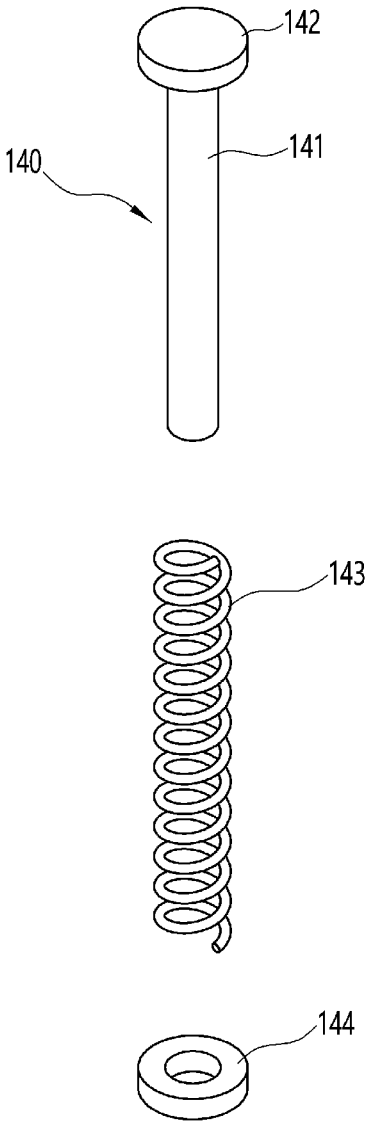

[FIG. 14]
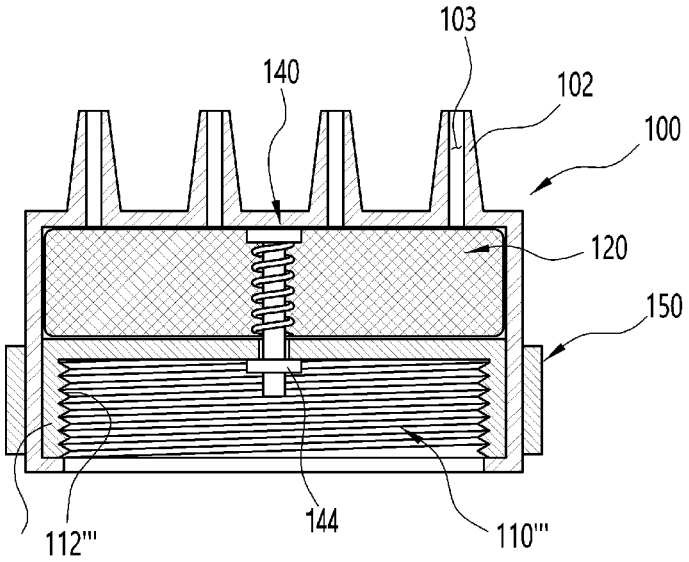
[FIG. 15]
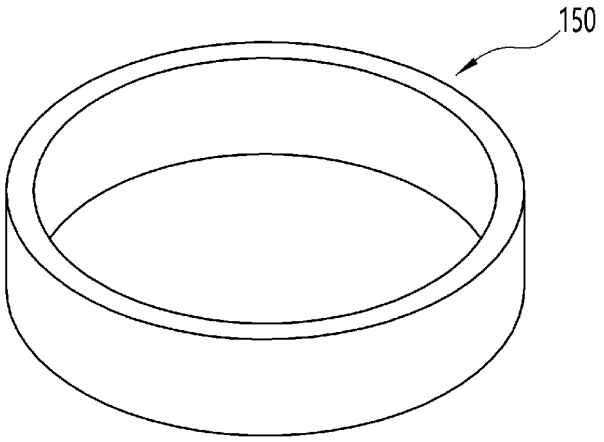

[FIG. 16]
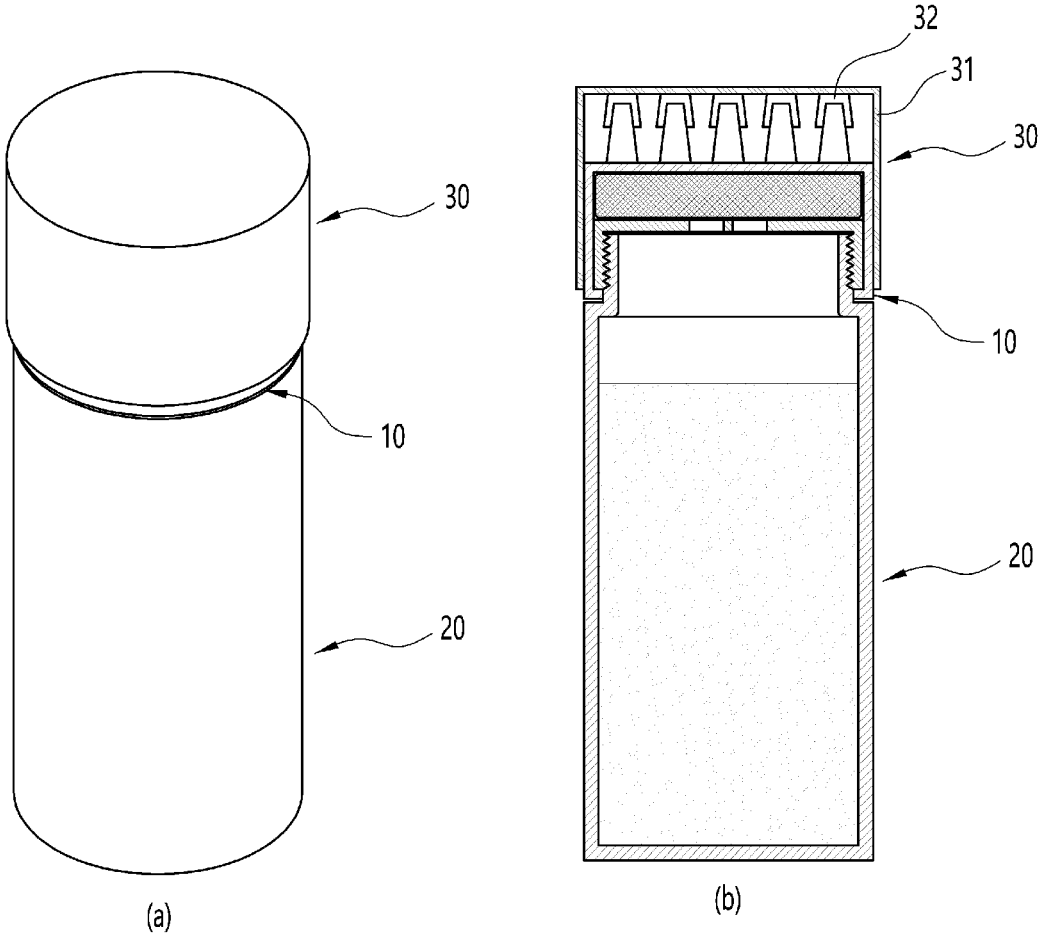

[FIG. 17]
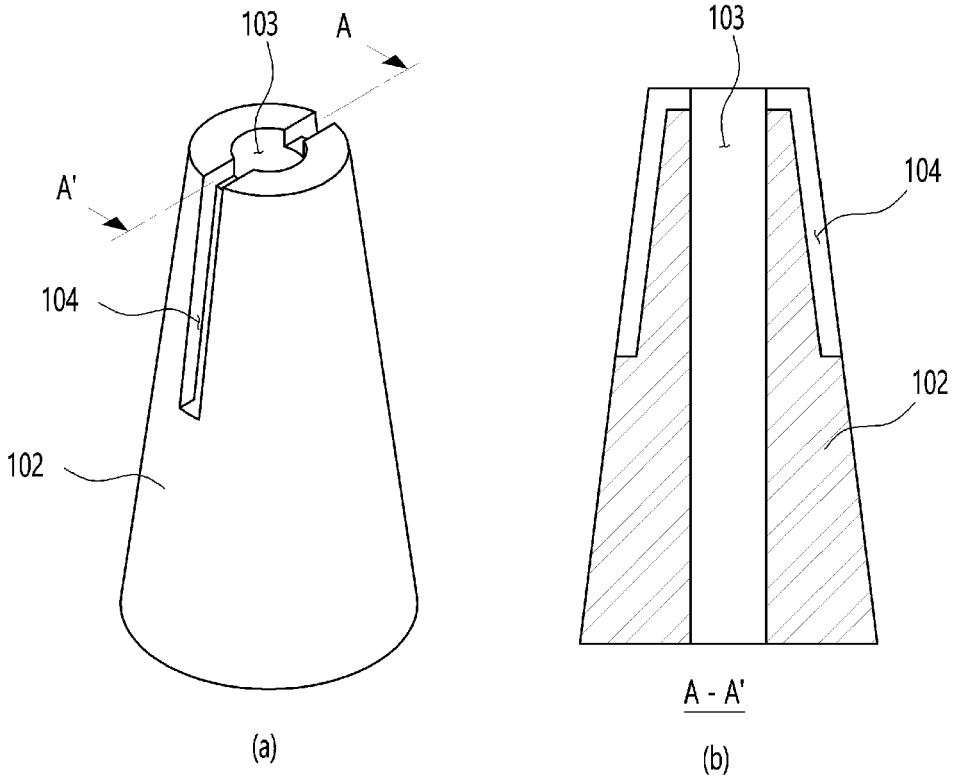

[FIG. 18]
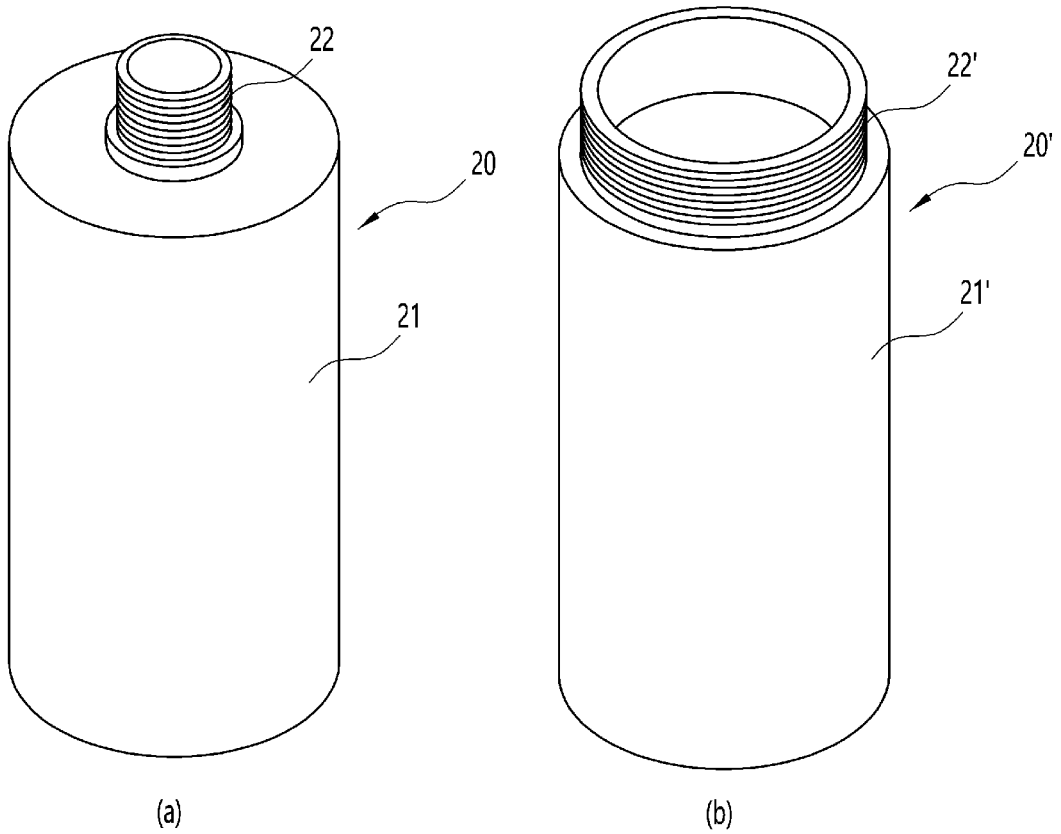

CAP FOR SCALP CARE CONTAINER CAPABLE OF APPLYING LIQUID

TECHNICAL FIELD

The present invention relates to a cap for a scalp care container capable of applying a liquid and more particularly, to a cap for a scalp care container capable of applying a liquid in which a scalp care liquid is not ordinarily leaked, but a brush of the cap is tapped onto the scalp with appropriate pressure and only upon the massage, the liquid may be applied onto the scalp side.

BACKGROUND ART

In general, for alleviation of hair loss or hair restoration, a method of massaging the scalp using a finger tip or a comb to smoothly supply the blood and the nutrition to the scalp has been used. In addition to such a massage, recently, various functional liquid chemicals for alleviation of hair loss or hair restoration have been developed and supplied to the market, and many solutions for dyeing have been purchased.

These functional liquid chemicals have been sprayed or sprayed on the hands to be applied to the scalp. In the case of dyeing, the solutions are applied on the comb and then the hair is combed. However, in the case of the spraying method, it is difficult to directly apply the functional liquid chemicals to the scalp by the hair, and in a method of applying the functional liquid chemicals to the scalp after spraying on the hands, there is a problem that the functional liquid tends to have a feeling of refusal to come into direct contact with the hand and is absorbed into the skin of the hand, resulting in an excessive use amount.

Korean Patent Application No. 10-2005-0081584 relates to an applying stopper for a liquid medicament container comprising: a stopper body which is coupled to a packing container in which a liquid medicament is stored and has a discharging hole at the center; a switching unit which is arranged inside the stopper body in the state that its outward elasticity is maintained and discharges and blocks the liquid medicament by opening or closing the discharging hole in an elastic manner; and an applying unit which is fixed to a front end of the stopper body by means of a cap so as to absorb the discharged medicament and allow users to uniformly apply the medicament to their affected part, in which the discharging hole of the stopper body has the same inner diameter and extends to a predetermined length, the opening and closing portion is configured to slidably move along an inner diameter of the discharging hole in a closely contacted state, and the discharging hole is opened only when the opening and closing portion moves by a predetermined distance.

Korean Patent Application No. 10-2013-0092294 relates to an apparatus for multi-functional convergent scratching and massaging, comprising a shaft-shaped body part; a curve fork-shaped scratching part installed on the body part; a massaging body part which is installed on the body part and has at least one protrusion member; a coating part which is installed on the body part and includes a storage part to store a liquid coating agent and a cover part which supports physically a fabric member with microperforation to spread the liquid coating agent to the outside and is detachably coupled to the storage part; and a patch attaching part which is detachably coupled to the storage part.

Korean Utility Model Application No. 20-2001-0014055 relates to a hair brush for applying a liquid chemical for uniformly applying a predetermined liquid chemical to the scalp and the hair, in which a liquid chemical injection pipe is formed in comb teeth formed on a brush body, balls for applying the liquid chemical is installed to apply the liquid chemical to the scalp when the liquid chemical smears from the end portion of the liquid chemical injection pipe, thereby allowing a user to easily apply the predetermined liquid chemical to the scalp and the hair and preventing damage to the clothes or the skin due to the liquid chemical.

However, in such a configuration, there are problems in that while the liquid container is coupled to the liquid storage unit, the liquid may be leaked in a direction before the liquid is actually applied to the scalp or the skin, and since small balls are used therein, it is difficult to manufacture the small balls and manufacturing costs are expensive.

DISCLOSURE

Technical Problem

The present invention has been made in an effort to provide a cap for a scalp care container capable of applying a liquid which can prevent the leakage of the liquid when not in use and massage the scalp by adding elasticity to bristles.

Further, the present invention has been made in an effort to provide a cap for a scalp care container capable of applying a liquid which can reduce the probability of failure and reduce manufacturing costs by using a simple structure.

Technical Solution

In order to achieve the objects, the present invention provides a cap for a scalp care container capable of applying a liquid which is coupled to a scalp care container, in which the cap includes an upper cap provided with a plurality of bristles protruding forward and a lower cap coupled to the upper cap and fastened to the scalp care container.

The upper cap may include an upper cap body having a cylindrical or polygonal tubular shape of which the bottom is opened, and the bristle protruding forward from the top of the upper cap body and having through hole at the inside of the bristle.

The lower cap may include an upper cap joint portion having a cylindrical or polygonal tubular shape of which the bottom is opened, a plurality of liquid injection holes formed at the top of the upper cap joint portion, and a container joint portion formed at the bottom of the liquid injection holes, and an outer circumferential surface of the upper cap joint portion is fixed by closely contacting an inner circumferential surface of the upper cap body.

A predetermined space may be formed between the upper cap and the lower cap and a sponge may be mounted in the space. Since the sponge is installed, it is possible to prevent the liquid from being suddenly ejected and administer only a predetermined amount. The space may be equal to or larger than the sponge in size. Further, the space may be smaller than the sponge in size, and even when the space is smaller than the sponge in size, the sponge is compressed to prevent the liquid permeating the sponge from being suddenly released to the outside through the through holes of the brush.

The lower cap may include an upper cap joint portion having a cylindrical or polygonal tubular shape of which the top is opened, a plurality of liquid injection holes formed at the bottom of the upper cap joint portion, and a container joint portion protruding from the bottom of the liquid injection holes, and an outer circumferential surface of the upper cap joint portion may be fixed by closely contacting an inner circumferential surface of the upper cap body.

Further, the lower cap may include a container joint portion having a cylindrical or polygonal tubular shape of which the bottom is opened and a plurality of liquid injection holes formed at the top of the container joint portion, and an outer circumferential surface of the container joint portion may be partially fixed by closely contacting an inner circumferential surface of the upper cap body.

Further, the lower cap may include a container joint portion having a cylindrical or polygonal tubular shape of which the bottom is opened and a plurality of liquid injection holes formed at the top of the container joint portion, and an outer circumferential surface of the container joint portion may be fixed by closely contacting an inner circumferential surface of the upper cap body.

Further, the lower cap may include a container joint portion having a cylindrical or polygonal tubular shape of which the bottom is opened, liquid injection holes formed on the top of the container joint portion, and a liquid injection adjusting member which is inserted to the liquid injection holes to open or close the injection of the liquid while moving vertically by pressure of the bristle and elastic force of an elastic member. The liquid injection adjusting member may include a moving shaft moving vertically along the liquid injection hole, an upper stopper formed at the upper end of the moving shaft, an elastic member inserted between the upper surface of the container joint portion and the upper stopper to give elastic restoring force of the moving shaft, and a lower stopper fitted to the bottom of the container joint portion to serve as a packing.

Further, the upper cap may include an upper cap body having a cylindrical or polygonal tubular shape of which the bottom is opened, and a plurality of through holes formed at the top of the upper cap body.

The cover for covering the upper cap may be further included at the outside of the upper cap. The cover may use a hard polymer such as plastic and in this case, since the bristle is made of a soft material, only the cover may serve as a packing. Further, the cover may include a cover body having a cylindrical or polygonal tubular shape of which the bottom is opened and through hole packing caps for blocking the through hole of the bristle.

A groove for facilitating the injection of the liquid may be formed at the upper end of the bristle of the upper cap and the liquid may be injected through the groove.

Advantageous Effects

According to the embodiment of the present invention, in the cap for a scalp care container capable of applying a liquid, the cap has the brush having elasticity and the liquid is supplied only when the bristle applies pressure while contacting the scalp by adding a sponge into the cap, thereby preventing the liquid from being leaked when not in use.

Further, since the liquid is supplied only when the brush is tapped onto the scalp, the scalp is weakly stimulated, thereby promoting the health of the scalp.

Further, since the structure of the present invention is simple, there is no possibility of failure and manufacturing costs and manufacturing time are reduced.

DESCRIPTION OF DRAWINGS

FIG. 1 is a perspective view of a scalp care container having a cap according to the present invention.

FIG. 2 is a cross-sectional view for a first embodiment of the cap according to the present invention.

FIG. 3 is a perspective view for a lower cap in the first embodiment.

FIG. 4 is a cross-sectional view for a second embodiment of the cap according to the present invention.

FIG. 5 is a perspective view for a lower cap in the second embodiment.

FIG. 6 is a cross-sectional view for a third embodiment of the cap according to the present invention.

FIG. 7 is a cross-sectional view for a fourth embodiment of the cap according to the present invention.

FIG. 8 is a perspective view for lower caps of the third and fourth embodiments.

FIG. 9 is another embodiment for an upper cap according to the present invention.

FIG. 10 is a cross-sectional view for a fifth embodiment of the cap according to the present invention.

FIG. 11 is a perspective view for a lower cap and a liquid injection adjusting member of the fifth embodiment.

FIG. 12 is a perspective view for the lower cap in the fifth embodiment.

FIG. 13 is a perspective view for the liquid injection adjusting member of the fifth embodiment.

FIG. 14 is a cross-sectional view of an additional upper cap fixing ring in the fifth embodiment.

FIG. 15 is a perspective view of the fixing ring of FIG. 14.

FIG. 16 is a perspective view and a cross-sectional view of a form in which a cover is attached to the cap according to the present invention.

FIG. 17 is a perspective view and a cross-sectional view of a brush of the upper cap according to the present invention.

FIG. 18 is a perspective view for a scalp care container coupled with the cap according to the present invention.

MODES OF THE INVENTION

According to a best aspect of the present invention, in a cap 10 for a scalp care container capable of applying a liquid which is coupled to a scalp care container 20, the cap 10 is configured by an upper cap 100 provided with a plurality of bristles 102 protruding forward and a lower cap 110 coupled to the upper cap 100 and fastened to the scalp care container 20.

Hereinafter, embodiments of the present invention in which the above objects can be specifically implemented will be described in detail with reference to the accompanying drawings. When describing the embodiments, like names and reference numerals designate like components and as a result, the additional description will be omitted.

FIG. 1 is a perspective view of a scalp care container having a cap according to the present invention, FIG. 2 is a cross-sectional view for a first embodiment of the cap according to the present invention, FIG. 3 is a perspective view for a lower cap in the first embodiment, FIG. 4 is a cross-sectional view for a second embodiment of the cap according to the present invention, FIG. 5 is a perspective view for a lower cap in the second embodiment, FIG. 6 is a cross-sectional view for a third embodiment of the cap according to the present invention, FIG. 7 is a cross-sectional view for a fourth embodiment of the cap according to the present invention, FIG. 8 is a perspective view for lower caps of the third and fourth embodiments, FIG. 9 is another embodiment for an upper cap according to the present invention, FIG. 10 is a cross-sectional view for a fifth embodiment of the cap according to the present invention, FIG. 11 is a perspective view for a lower cap and a liquid injection adjusting member of the fifth embodiment, FIG. 12 is a perspective view for the lower cap in the fifth embodiment, FIG. 13 is a perspective view for the liquid injection adjusting member of the fifth embodiment, FIG. 14 is a cross-sectional view of an additional upper cap fixing ring in the fifth embodiment, FIG. 15 is a perspective view of the fixing ring of FIG. 14, FIG. 16 is a perspective view and a cross-sectional view of a form in which a cover is attached to the cap according to the present invention, FIG. 17 is a perspective view and a cross-sectional view of a brush of the upper cap according to the present invention, and FIG. 18 is a perspective view for a scalp care container coupled with the cap according to the present invention.

FIG. 1 is a perspective view of a scalp care container 1 having a cap according to the present invention. As illustrated in the drawing, the scalp care container 1 is configured by a cap 10 and a container 20.

FIG. 2 is a cross-sectional view for a first embodiment of the cap 10 according to the present invention and FIG. 3 is a perspective view for a lower cap 110 in the first embodiment. As illustrated in the drawings, the cap 10 is configured by an upper cap 100 and the lower cap 110. The upper cap 100 is configured by an upper cap body 101 having a cylindrical or polygonal tubular shape of which the bottom is opened, a bristle 102 protruding forward from the upper cap body 101, and through hole 103 communicating with the upper cap body 101 to the inside of the bristle 102. The top of the upper cap body 101 on which the bristle 102 is formed may be formed in a plane or convex shape as illustrated in the drawings. The lower cap 110 is configured by an upper cap joint portion 114 having a cylindrical or polygonal tubular shape (not illustrated) of which the bottom is opened and a container joint portion 111 formed inside the joint portion 114 in a form of an opened bottom, and a liquid injection hole 113 is provided at the top of the container joint portion 111 so that the liquid in the container 20 is injected. The inside of the container joint portion 111 has a thread 112 and is coupled to the container 20 through the thread 112. The container joint portion 111 may be coupled to the container by various coupling methods other than the thread. For example, a hook method, a method of forming a plurality of rings in a spout portion 22 of the container, and a method of press-fitting the cap 10 may be used, and such a design modification is just apparent to those skilled in the art to which the present invention pertain.

Further, a space is formed between the upper cap 100 and the lower cap 110 and the sponge 120 is inserted into the space 130. Accordingly, the liquid injected into the liquid injection hole 113 permeates the sponge 120 and the liquid permeating the sponge 120 is released to the through holes 103 of the brush 102 by the pressure when the container 20 is tapped onto the scalp to be administered to the scalp. The space 120 may also be configured to have a volume which is equal to or larger than the size of the sponge. When the space 130 is larger than the sponge 120 in size, the liquid may be temporarily stored in the space, and as a result, when the brush 102 applies the pressure to the scalp while being tapped, the liquid may be more easily and strongly administered to the scalp though the through holes 103 by the pressure of air.

The upper cap 100 may be generally made of an elastic material. Accordingly, rubber, silicon, an elastic soft polymer, or the like may be used. Since the upper cap 100 is made of rubber, silicon, or the like, a separate packing may not be required, and if necessary, in order to prevent the liquid from being leaked, packing (not illustrated) may be further added to a coupling portion between the upper cap 100 and the lower cap 110.

The sponge 120 may use a sponge in which the liquid remains, but is not easily penetrated. Accordingly, the sponge 120 may use a high-density sponge. Further, the sponge 120 may be made and used to have a high density by closely contacting the upper cap 100 and the lower cap 110. Generally, a sponge made of a puff material of cosmetics which are used on the market may be used. Further, the sponge 120 is modified to a cylindrical shape of which the top is opened and may be used to be compressed to the upper cap 100 and the lower cap 110.

The lower cap 110 may be made of a hard plastic or metallic material which is generally used in cosmetics or containers.

FIGS. 4 and 5 are diagrams for a second embodiment of the cap 10 according to the present invention. As illustrated in the drawings, like the first embodiment, the upper cap 100 is configured by an upper cap body 101 having a cylindrical or polygonal tubular shape (not illustrated) of which the bottom is opened, a bristle 102 protruding forward from the upper cap body 101, and through hole—103 communicating with the upper cap body 101 to the inside of the bristle 102. The top formed with the bristle of the upper cap body 101 may be formed in a plane or convex shape. Unlike the first embodiment, a lower cap 110' is configured by an upper cap joint portion 114' having a cylindrical or polygonal tubular shape (not illustrated) of which the top is opened and a container joint portion 111' formed inside the joint portion 114' in a form of an opened bottom, and a liquid injection hole 113' is provided at the top of the container joint portion 111' so that the liquid in the container 20 is injected. The inside of the container joint portion 111' has a thread 112' and is coupled to the container 20 through the thread 112'. As described in the first embodiment, the container joint portion 111' may be coupled to the container by various coupling methods other than the thread. For example, a hook method, a method of forming a plurality of rings in a spout portion 22 of the container, and a method of press-fitting the cap 10 may be used, and such a design modification is just apparent to those skilled in the art to which the present invention pertain.

Further, a space is formed between the upper cap 100 and the lower cap 110' and the sponge 120 is inserted into the space 130. Accordingly, the liquid injected through the liquid injection hole 113' permeates the sponge 120 and the liquid permeating the sponge 120 is released to the through hole 103 of the bristle 102 by the pressure when the container 20 is tapped onto the scalp to be administered to the scalp. The space 120 may also be configured to have a volume which is equal to or larger than the size of the sponge. When the space 130 is larger than the sponge 120 in size, the liquid may be temporarily stored in the space, and thus, the liquid may be more easily administered to the scalp through the through holes 103.

The upper cap 100 may be generally made of an elastic material.

Accordingly, rubber, silicon, an elastic soft polymer, or the like may be used. Since the upper cap 100 is made of rubber, silicon, or the like, a separate packing may not be required, and if necessary, in order to prevent the liquid from being leaked, a packing (not illustrated) may be further added to a coupling portion between the upper cap 100 and the lower cap 110'.

The sponge 120 may use a sponge in which the liquid remains, but is not easily penetrated. Accordingly, the sponge 120 may use a high-density sponge. Further, the sponge 120 may be made and used to have a high density by closely contacting the upper cap 100 and the lower cap 110'. Generally, a sponge made of a puff material of cosmetics which are used on the market may be used. Further, the sponge 120 is modified to a cylindrical shape of which the top is opened and may be used to be compressed to the upper cap 100 and the lower cap 110'.

The lower cap 110' may be made of a hard plastic or metallic material which is generally used in cosmetics or containers.

FIGS. 6 and 8 are diagrams for a cap according to a third embodiment of the present invention. As illustrated in the drawings, like the first embodiment, the upper cap 100 is configured by an upper cap body 101 having a cylindrical or polygonal tubular shape (not illustrated) of which the bottom is opened, a bristle 102 protruding forward from the upper cap body 101, and through hole 103 communicating with the upper cap body 101 to the inside of the bristle 102. The top formed with the brush of the upper cap body 101 may be formed in a plane or convex shape. Unlike the first embodiment, the upper cap joint portion 114 is not formed, and a lower cap 110" has a container joint portion 111" having a cylindrical shape or polygonal tubular shape (not illustrated) of which the bottom is opened and a liquid injection hole 113" formed at the top of the container joint portion 111" so that the liquid in the container 20 is injected. The inside of the container joint portion 111" has a thread 112" and is coupled to the container 20 through the thread 112". As described in the first embodiment, the container joint portion 111" may be coupled to the container by various coupling methods other than the thread. For example, a hook method, a method of forming a plurality of rings in a spout portion 22 of the container, and a method of press-fitting the cap 10 may be used, and such a design modification is just apparent to those skilled in the art to which the present invention pertain.

An outer circumference surface of the container joint portion 111" is partially inserted to an inner circumference surface of the body 101 of the upper cap 100 and the sponge 120 is inserted to a space 130 formed by the upper cap 100 and the lower cap 110".

Accordingly, the liquid injected through the liquid injection hole 113" permeates the sponge 120 and the liquid permeating the sponge 120 is released to the through holes 103 of the brush 102 by the pressure when the container 20 is tapped onto the scalp to be administered to the scalp.

The upper cap 100 may be generally made of an elastic material. Accordingly, rubber, silicon, an elastic soft polymer, or the like may be used. Since the upper cap 100 is made of rubber, silicon, or the like, a separate packing may not be required, and if necessary, in order to prevent the liquid from being leaked, a packing (not illustrated) may be further added to a coupling portion between the upper cap 100 and the lower cap 110".

The sponge 120 may use a sponge in which the liquid remains, but is not easily penetrated. Accordingly, the sponge 120 may use a high-density sponge. Further, the sponge 120 may be made and used to have a high density by closely contacting the upper cap 100 and the lower cap 110". Generally, a sponge made of a puff material of cosmetics which are used on the market may be used. Further, the sponge 120 is modified to a cylindrical shape of which the top is opened and may be used to be compressed to the upper cap 100 and the lower cap 110".

The lower cap 110" may be made of a hard plastic or metallic material which is generally used in cosmetics or containers.

FIGS. 7 and 8 are diagrams for a cap 10 according to a fourth embodiment. As illustrated in the drawings, like the first embodiment, the upper cap 100 is configured by an upper cap body 101 having a cylindrical or polygonal tubular shape (not illustrated) of which the bottom is opened, a bristle 102 protruding forward from the upper cap body 101, and through hole 103 communicating with the upper cap body 101 to the inside of the bristle 102. Unlike the first embodiment, the upper cap joint portion 114 is not formed, and a lower cap 110" has a container joint portion 111" having a cylindrical shape or polygonal tubular shape (not illustrated) of which the bottom is opened and a liquid injection hole 113" formed at the top of the container joint portion 111" so that the liquid in the container 20 is injected. The inside of the container joint portion 111" has a thread 112" and is coupled to the container 20 through the thread 112". As described in the first embodiment, the container joint portion 111" may be coupled to the container by various coupling methods other than the thread. For example, a hook method, a method of forming a plurality of rings in a spout portion 22 of the container, and a method of press-fitting the cap 10 may be used, and such a design modification is just apparent to those skilled in the art to which the present invention pertain. An outer circumference surface of the container joint portion 111" is completely inserted to an inner circumference surface of the body 101 of the upper cap 100 and the sponge 120 is inserted to a space 130 formed by the upper cap 100 and the lower cap 110".

Accordingly, the liquid injected through the liquid injection hole 113" permeates the sponge 120 and the liquid permeating the sponge 120 is released to the through holes 103 of the brush 102 by the pressure when the container 20 is tapped onto the scalp to be administered to the scalp.

The upper cap 100 may be generally made of an elastic material. Accordingly, rubber, silicon, an elastic soft polymer, or the like may be used. Since the upper cap 100 is made of rubber, silicon, or the like, a separate packing may not be required, and if necessary, in order to prevent the liquid from being leaked, a packing (not illustrated) may be further added to a coupling portion between the upper cap 100 and the lower cap 110".

The sponge 120 may use a sponge in which the liquid remains, but is not easily penetrated. Accordingly, the sponge 120 may use a high-density sponge.

Further, the sponge 120 may be made and used to have a high density by closely contacting the upper cap 100 and the lower cap 110". Generally, a sponge made of a puff material of cosmetics which are used on the market may be used. Further, the sponge 120 is modified to a cylindrical shape of which the top is opened and may be used to be compressed to the upper cap 100 and the lower cap 110".

The lower cap 110" may be made of a hard plastic or metallic material which is generally used in cosmetics or containers.

FIG. 9 is a diagram illustrating another embodiment of an upper cap 100' according to the present invention. As illustrated in the drawing, the upper cap 100' has only through holes 102' without a brush on a body 101'. The upper cap 100' may be applied to a case where there is a need of administering a liquid to the skin or a large area. Since other configurations such as the lower cap 110 and the sponge 120 may be applied to another embodiment as they are, the detailed description will be omitted.

FIGS. 10 and 15 are diagrams for a cap according to a fifth embodiment of the present invention. As illustrated in FIG. 10, the upper cap 100 is configured by a plurality of bristles 102 and a body 101 for forming a space to which a lower cap 110''' and a sponge 120 are inserted. Since the upper cap 100 is the same configuration described above, the detailed description will be omitted. The configuration of the sponge 120 is the same configuration described above and however, the liquid injection adjusting member 140 is inserted to the sponge 120. As illustrated in FIG. 10, the lower cap 110''' has a liquid injection hole 113''' provided at the upper center of a container joint portion 111''' and the liquid injection adjusting member 140 is inserted through the liquid injection hole 113'''. A thread 112''' is formed on an inner circumferential surface of the joint portion 111''' to be coupled to the cosmetic container 20. The liquid injection adjusting member 140 is configured by a moving shaft 141 moving vertically along the liquid injection hole 113''', an upper stopper 142 formed at the upper end of the moving shaft 141, an elastic member 143 positioned between the upper stopper 142 and the upper surface of the container joint portion 111''' of the lower cap, and a lower stopper 144 limiting the movement of the moving shaft 141 on the lower surface of the container joint portion 111''' and opening or closing the injection of the liquid injected through the liquid injection hole 113'''. Accordingly, the lower stopper 144 may be made of soft synthetic resin, rubber, or the like so as to perform a packing role. FIG. 13 illustrates an exploded perspective view of the liquid injection adjusting member 140. Generally, the upper stopper 142 is formed integrally with the moving shaft 141 and the lower stopper 142 needs to be fixed after inserting the moving shaft 141 to the liquid injection hole 113''' to be separately formed. However, the upper stopper 142 may be formed by a separate component.

FIGS. 14 and 15 illustrate that a fixing ring 150 is further added to the fifth embodiment. The fixing ring 150 is a configured so that the upper cap 100 closely contacts the lower cap 110'''. As illustrated in the drawings, after the lower cap 110''' is fitted into the upper cap 100, the fixing ring 150 is tightly fitted to the outer circumferential surface of the upper cap 100. As a result, the movement of the upper cap 100 may be fixed. The fixing ring 150 may be applied even to other embodiments as well as the present embodiment.

FIG. 16 is a diagram illustrating that the cover 30 is formed on the cap 10. As illustrated in FIG. 16, the cover 30 may be formed in various shapes. In the drawing, the cover 30 is configured by a cover body 31 and a packing cap 31 formed on the bottom of the cover body 31. The bristle 102 of the upper cap is inserted to the packing cap 31 and the packing cap 31 may completely prevent the liquid from being released to the outside through the through hole 103 of the bristle 102. Further, even though only the cover 30 is formed, when the surface formed by the end of the brush and the surface of the cover are the same as each other, only the cover itself may perform a packing role. Further, a soft packing material (not illustrated) is inserted to the inside of the cover, thereby achieving the same effect.

FIG. 17 illustrates that a groove 104 is formed on the bristle 102. As illustrated in the drawing, the groove 104 is formed on the upper end of the brush 102, and when the groove 104 contacts the scalp, the skin, or the like at the upper end of the bristle 102, the scalp or the skin serve as a packing to make it difficult for the liquid to be released. Accordingly, in preparation for the case, the groove 104 is formed on the upper end of the bristle 102 so that the liquid may be easily administered to the scalp or the like through the through hole 103.

FIG. 18 is a diagram for the container 20. As illustrated in the drawing, the container 20 may be formed in various shapes, and as illustrated in FIG. 18A, the spout portion 22 coupled with the cap may be formed to be thinner than the diameter of the body 21, and as illustrated in FIG. 18B, a spout portion 22' may be largely formed and if necessary, the spout portion 22' may also be formed with the same size as the diameter of the body 21'. In FIG. 12A, the cap 10 may be formed to have the same as or similar to the diameter of the container 20.

As described above, the present invention can be variously modified and preferred embodiments of the present invention are described, but the present invention is not limited to these embodiments. It should be understood that techniques which can be modified and used by those skilled in the art in claims and the detailed description of the present invention are included in the scope of the present invention.

INDUSTRIAL APPLICABILITY

The present invention relates to a cover for a scalp care container capable of applying a liquid and more particularly, to a cover for a scalp care container capable of applying a liquid in which a scalp care liquid is not ordinarily leaked, but a brush of the cover is tapped onto the scalp with appropriate pressure and only upon the massage, the liquid may be applied onto the scalp side, and therefore, the present invention is the invention having high industrial applicability.

The invention claimed is:

1. A cap for a scalp care container which is capable of applying a liquid, the cap being configured to be coupled to the scalp care container, the cap comprising:

an upper cap provided with a plurality of bristles made of an elastic material; and a lower cap coupled to the upper cap and configured to be fastened to the scalp care container, wherein the upper cap includes an upper cap body having a cylindrical tubular shape including a cylindrical side wall and a circular top surface, the cylindrical tubular shape including an open bottom, and each bristle of the plurality of bristles protrudes from the circular top surface of the upper cap body and has a through-hole at an inside of the bristle, wherein the lower cap includes a container joint portion having a cylindrical tubular shape including a cylindrical side wall and a circular top surface, the cylindrical tubular shape including an open bottom, a liquid injection through-hole formed in the circular top surface of the container joint portion, and a liquid injection adjusting member which is configured to open or close the liquid injection hole while moving vertically by pressure of the plurality of bristles and an elastic force of an elastic member, wherein the liquid injection adjusting member includes a moving shaft configured to move vertically through the liquid injection hole by pressure of the plurality of bristles and the elastic member, an upper stopper formed at an upper end of the moving shaft, the elastic member being inserted between the circular top surface of the container joint portion and the upper stopper to give an elastic restoring force of the moving shaft, and a lower stopper coupled to a lower surface of the circular top surface of the container joint portion to provide an upward force to prevent the moving shaft from falling out through the open bottom of the lower cap, wherein a groove for facilitating injection of the liquid is formed at an upper end of each bristle of the upper cap and is connected to the through-hole in the bristle, and the liquid is injected through the groove, wherein a predetermined space is formed between an inner lower surface of the circular top surface of the upper cap and the circular top surface of the container joint portion and a sponge is mounted in the predetermined space, wherein the liquid injection adjusting member moves to an open position in response to a vertical pressure on the plurality of bristles when the upper cap is pressed on a scalp to allow for a liquid of the scalp care container to permeate into the sponge, and wherein the liquid permeated into the sponge is configured to be applied to the scalp through the through-holes and the grooves formed at the upper ends of the bristles of the upper cap.

* * * * *